US010192497B2

(12) United States Patent
Morimoto

(10) Patent No.: US 10,192,497 B2
(45) Date of Patent: Jan. 29, 2019

(54) IMAGE DISPLAY DEVICE AND METHOD FOR DIMMING LIGHT SOURCE

(71) Applicant: NEC Display Solutions, Ltd., Tokyo (JP)

(72) Inventor: Takeshi Morimoto, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 15/316,809

(22) PCT Filed: Jul. 4, 2014

(86) PCT No.: PCT/JP2014/067938

§ 371 (c)(1),
(2) Date: Dec. 6, 2016

(87) PCT Pub. No.: WO2016/002075

PCT Pub. Date: Jan. 7, 2016

(65) Prior Publication Data

US 2017/0154586 A1 Jun. 1, 2017

(51) Int. Cl.
*G09G 3/00* (2006.01)
*G09G 3/36* (2006.01)
(Continued)

(52) U.S. Cl.
CPC ..... *G09G 3/36* (2013.01); *G09G 3/2003* (2013.01); *G09G 3/3406* (2013.01);
(Continued)

(58) Field of Classification Search
CPC . G09G 2320/0626; G09G 3/36; G09G 3/2003
See application file for complete search history.

(56) References Cited

U.S. PATENT DOCUMENTS

2007/0001997 A1* 1/2007 Kim ..... G09G 3/3406 345/102
2008/0117160 A1* 5/2008 Oka ..... G09G 3/3406 345/102
(Continued)

FOREIGN PATENT DOCUMENTS

CN 100470626 C 3/2009
CN 102087840 A 6/2011
(Continued)

OTHER PUBLICATIONS

International Search Report (ISR) (PCT Form PCT/ISA/210), in PCT/JP2014/067938, dated Sep. 30, 2014.
(Continued)

*Primary Examiner* — Muhammad N Edun
(74) *Attorney, Agent, or Firm* — McGinn I.P. Law Group, PLLC.

(57) ABSTRACT

An image display device and a light source dimming method are provided for enabling display of an image with natural brightness through dimming control. The image display device includes: a light source; a display unit that spatially modulates light from the light source on the basis of an input video e signal to form an image; a histogram acquisition unit that, on the basis of the input video signal, acquires a first histogram, in which image data is indicated by the frequencies of levels of brightness, and a second histogram having a number of levels of brightness that differs from the number of levels of brightness of the first histogram; and a control unit that performs dimming control that adjusts the luminance of the light source on the basis of the first and second histograms.

20 Claims, 7 Drawing Sheets

(51) Int. Cl.
*G09G 3/20* (2006.01)
*G09G 3/34* (2006.01)

(52) U.S. Cl.
CPC . *G09G 2320/0238* (2013.01); *G09G 2320/06* (2013.01); *G09G 2320/062* (2013.01); *G09G 2320/0626* (2013.01); *G09G 2360/16* (2013.01)

(56) References Cited

U.S. PATENT DOCUMENTS

| | | | | |
|---|---|---|---|---|
| 2009/0115907 | A1 | 5/2009 | Baba et al. | |
| 2009/0167672 | A1* | 7/2009 | Kerofsky | G09G 3/3413 345/102 |
| 2013/0063496 | A1* | 3/2013 | Basler | H04N 13/0404 345/690 |
| 2013/0147853 | A1 | 6/2013 | Hsu et al. | |
| 2013/0287313 | A1* | 10/2013 | Marchessoux | G09G 5/10 382/274 |

FOREIGN PATENT DOCUMENTS

| | | | |
|---|---|---|---|
| JP | 2003-036063 | A | 2/2003 |
| JP | 2005-308792 | A | 11/2005 |
| JP | 2007-164208 | A | 6/2007 |
| JP | 2008-129251 | A | 6/2008 |
| JP | 2009-109900 | A | 5/2009 |
| JP | 2011-118195 | A | 6/2011 |
| JP | 2014-059530 | A | 4/2014 |
| WO | WO 2011/010357 | A1 | 1/2011 |

OTHER PUBLICATIONS

Japanese Decision to Grant a Patent dated Jul. 31, 2018 in a counterpart Japanese Application No. 2016-530789 with an English translation thereof.

Chinese Office Action dated Aug. 23, 2018 in a counterpart Chinese Application No. 201480080382.1 with an English translation.

* cited by examiner

IMAGE DISPLAY DEVICE AND METHOD FOR DIMMING LIGHT SOURCE

TECHNICAL FIELD

The present invention relates to an image display device in which dimming control of the light source is performed and to a method for dimming a light source.

BACKGROUND ART

As a light source dimming method in, for example, a liquid crystal display device, a method is described in Patent Document 1 in which an average luminance value is calculated from a video signal that is acquired during a fixed time interval and the luminance of the backlight is then controlled on the basis of the average luminance value. In this control method, the luminance of the backlight is decreased when the average luminance value surpasses a threshold value, and the luminance of the backlight is increased when the average luminance value falls below a threshold value. In this way, the brightness of the screen can be adjusted to the optimum brightness according to the luminance level of the video.

In the above-described control method, however, because the luminance of the backlight is controlled only by the average luminance value of the video signal regardless of the characteristics of the image, the optimum brightness is not achieved in some cases due to image characteristics.

For example, a first image in which the central region is white and the peripheral regions are black and a second image in which the entire image is an intermediate color such as grey may have the same average luminance even though the image characteristics thereof are different from each other. Normally, in order to display these first and second images at optimal brightness, the luminance of the backlight must be appropriately controlled for each of the first and second images. In the control method described above, however, the luminance of the backlight for these first and second images will be the same, and display of the first and second images at the optimum brightness will therefore encounter problems.

In response, a liquid crystal display device has been proposed in Patent Document 2 in which the luminance of the backlight is adjusted by using, in addition to the average luminance value, histograms that indicate the characteristics of image.

In the liquid crystal display device described in Patent Document 2, a three-level histogram is created on the basis of an input video signal. Here, the three-level histogram is of a form in which the levels of brightness are represented by the three levels of low luminance, intermediate luminance, and high luminance, and each picture element value of image data is graphed by the different levels.

The characteristics of an image are determined on the basis of a three-level histogram, and the light quantity of the backlight is adjusted on the basis of the characteristics quantity of the image that is indicated by the frequency of predetermined brightness levels (for example, the frequency of the high-luminance side) of the three-level histogram. In this way, control of the light quantity according to the characteristics of each image can be carried out for the above-described first and second images whose characteristics are different from each other.

LITERATURE OF THE PRIOR ART

Patent Documents

Patent Document 1: Japanese Unexamined Patent Application Publication No. 2005-308792

Patent Document 2: Japanese Unexamined Patent Application Publication No. 2008-129251

DISCLOSURE OF THE INVENTION

As described hereinabove, the control method disclosed in Patent Document 1 has the problem of the difficulty of displaying images having different characteristics at the optimum brightness.

The liquid crystal display device described in Patent Document 2, on the other hand, has the problem described below.

In the control of light quantity that uses a three-level histogram, the image characteristics quantity can only be roughly detected, and the light quantity of the backlight can therefore only be roughly adjusted. As a result, the brightness of the displayed image will be unnatural in some cases.

If a detailed histogram of 16 levels is used in place of a three-level histogram, the image characteristics quantity can be detected more precisely, and the light quantity of the backlight can therefore be precisely adjusted. In this case, however, the process of detecting the image characteristics to distinguish the first and second images described above becomes increasingly complex as the levels of brightness become more detailed.

It is an object of the present invention to provide an image display device and light source dimming method that can provide an image that has natural brightness by dimming control and thus solve the above-described problem.

According to an aspect of the present invention for achieving the above-described object, an image display device is provided that includes:

a light source;

a display unit that spatially modulates light from the light source on the basis of an input video signal to form an image;

a histogram acquisition unit that acquires, on the basis of the input video signal, a first histogram, in which image data is indicated by the frequencies of levels of brightness, and a second histogram that has a number of levels of brightness that differs from the number of levels of brightness of the first histogram; and a control unit that implements dimming control for adjusting the luminance of the light source on the basis of the first histogram and the second histogram.

According to another aspect of the present invention, a light source dimming method is provided that is the light source dimming method of an image display device in which light from a light source is spatially modulated by means of a display element on the basis of an input video signal to display an image, the method including:

acquiring, on the basis of the input video signal, a first histogram, in which image data is indicated by the frequencies of levels of brightness, and a second histogram that has a number of levels of brightness that differs from the number of levels of brightness of the first histogram; and performing dimming control for adjusting the luminance of the light source on the basis of the first histogram and the second histogram.

According to another aspect of the present invention, a light source dimming method is provided that is a light source dimming method of an image display device in which light from a light source is spatially modulated by means of a display element on the basis of an input video signal to display an image, the method including:

deriving two or more items of statistical data from the input video signal; and adjusting the luminance of the light source on the basis of the two or more items of statistical data.

DESCRIPTION OF EMBODIMENT

Exemplary embodiments of the present invention are next described with reference to the accompanying drawings.

(First Exemplary Embodiment)

Figure 1:
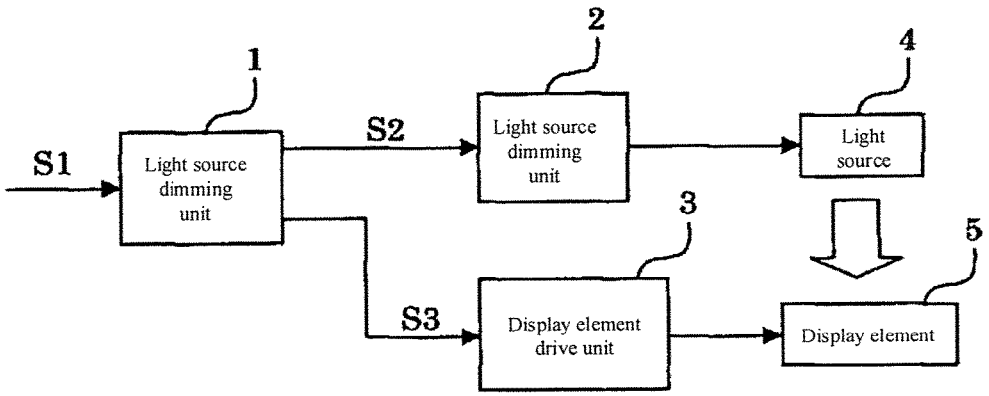
FIG. 1 is a block diagram showing the principal configuration of an image display device according the first exemplary embodiment of the present invention.

FIG. 1 is a block diagram showing the principal configuration of an image display device according to the first exemplary embodiment of the present invention.

Referring to FIG. 1, the image display device includes light source dimming unit 1, light source drive unit 2, display element drive unit 3, light source 4, and display element 5. Light source 4 is a mercury lamp or a solid-state light source such as an LED (light-emitting diode). Display element 5 is a display element that spatially modulates the light from light source 4 to form an image, and for example, is a component such as a liquid crystal display device.

Light source dimming unit 1 receives RGB signal S1 from an outside video supply device, supplies dimming signal S2 for controlling the luminance (or light quantity) of light source 4 to light source drive unit 2, and supplies RGB signal S3 for displaying images on display element 5 to display element drive unit 3. The outside video supply device is an information processing device such as a personal computer or a video apparatus such as a video recorder.

Light source drive unit 2 drives light source 4 in accordance with dimming signal S2. Display element drive unit 3 drives display element 5 in accordance with RGB signal S3.

Figure 2:
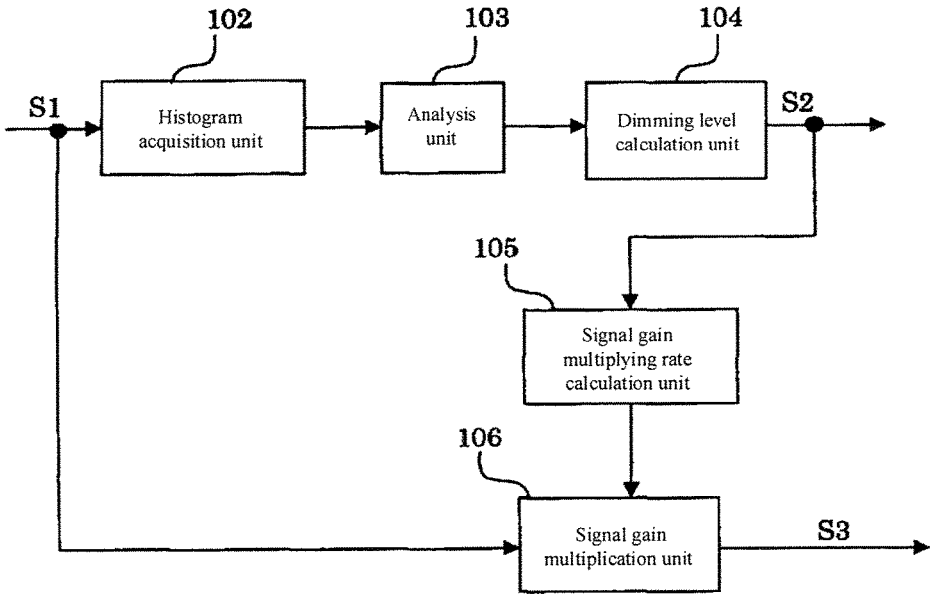
FIG. 2 is a block diagram showing the configuration of a light source dimming unit of the image display device shown in FIG. 1.

FIG. 2 is a block diagram showing the configuration of light source dimming unit 1. Referring to FIG. 2, light source dimming unit 1 includes histogram acquisition unit 102, analysis unit 103, dimming level calculation unit 104, signal gain multiplying rate calculation unit 105, and signal gain multiplication unit 106.

RGB signal S1 contains the three primary colors of light: red signal R, green signal G, and blue signal B. Histogram acquisition unit 102 calculates luminance signal Y from the RGB signal S1 in accordance with the following Formula 1.

$$Y=0.299\times R+0.587\times G+0.114\times B \quad \text{(Formula 1)}$$

In addition, histogram acquisition unit 102 acquires a 16-level histogram and a four-level histogram for each of luminance signal Y, a red signal R, a green signal G, and a blue signal B. In other words, histogram acquisition unit 102 acquires two or more items of statistical data. The acquisition of these histograms is carried out in units of one frame.

The procedure of acquiring a 16-level histogram is next described for a case in which RGB signal S1 is eight-bit digital data.

Histogram acquisition unit 102 has sixteen HistY[0]–HistY[15] as registers for creating a 16-level histogram that relates to luminance signal Y. These HistY[0]–HistY[15] are reset to zero at the time of the start of a frame, and are configured to hold count values at the time of completion of a frame. According to the addition conditions shown in Table 1 below, the count values of corresponding registers among HistY[0]–HistY[15] are added in accordance with the input data of luminance signal Y, whereby a 16-level histogram relating to luminance signal Y can be acquired.

TABLE 1

| NO | Input data | Register to be added |
|---|---|---|
| 0 | 16 > Y ≥ 0 | HistY[0] |
| 1 | 32 > Y ≥ 16 | HistY[1] |
| 2 | 48 > Y ≥ 32 | HistY[2] |
| 3 | 64 > Y ≥ 48 | HistY[3] |
| 4 | 80 > Y ≥ 64 | HistY[4] |
| 5 | 96 > Y ≥ 80 | HistY[5] |
| 6 | 112 > Y ≥ 96 | HistY[6] |
| 7 | 128 > Y ≥ 112 | HistY[7] |
| 8 | 144 > Y ≥ 128 | HistY[8] |
| 9 | 160 > Y ≥ 144 | HistY[9] |
| 10 | 176 > Y ≥ 160 | HistY[10] |
| 11 | 192 > Y ≥ 176 | HistY[11] |
| 12 | 208 > Y ≥ 192 | HistY[12] |
| 13 | 224 > Y ≥ 208 | HistY[13] |
| 14 | 240 > Y ≥ 224 | HistY[14] |
| 15 | 256 > Y ≥ 240 | HistY[15] |

Histogram acquisition unit 102 has sixteen HistR[0]–HistR[15] that are registers for the red signal R, sixteen HistG[0]–HistG[15] that are registers for the green signal G, and sixteen HistB[0]–HistB[15] that are registers for the blue signal B. These HistR[0]–HistR[15], HistG[0]–HistG[15], and HistB[0]–HistB[15] are also reset at the time of the start of a frame and are configured to hold count values at the time of completion of a frame.

The addition conditions of the red signal R are given by changing the registers to be added from HistY[0]–HistY[15] in Table 1 above to HistR[0]–HistR[15]. According to these addition conditions, the count values of the corresponding registers among HistR[0]–HistR[15] are added in accordance with the input data of the red signal R. In this way, a 16-level histogram relating to the red signal R can be acquired.

The addition conditions of the green signal G are given by changing the registers to be added from HistY[0]–HistY[15] in Table 1 above to HistG[0]–HistG[15]. According to these addition conditions, the count values of corresponding registers among HistG[0]–HistG[15] are added in accordance with the input data of the green signal G. In this way, a 16-level histogram relating to the green signal G can be acquired.

The addition conditions of the blue signal B are given by changing the registers to be added from HistY[0]–HistY[15] in Table 1 above to HistB[0]–HistB[15]. According to these addition conditions, the count values of corresponding registers among HistB[0]–HistB[15] are added in accordance with the input data of the blue signal B. In this way, a 16-level histogram relating to the blue signal B can be acquired.

In addition, histogram acquisition unit 102 has four HistLY[0]–HistLY[3] as registers for creating a four-level histogram relating to luminance signal Y. Count values are added to HistLY[0]–HistLY[3] in accordance with the following Formulas 2-5, whereby a four-level histogram can be calculated from the 16-level histogram for luminance signal Y.

$$\mathrm{Hist}LY[0]=\mathrm{Hist}Y[0]+\mathrm{Hist}Y[1]+\mathrm{Hist}Y[2]+\mathrm{Hist}Y[3] \quad \text{(Formula 2)}$$

$$\mathrm{Hist}LY[1]=\mathrm{Hist}Y[4]+\mathrm{Hist}Y[5]+\mathrm{Hist}Y[6]+\mathrm{Hist}Y[7] \quad \text{(Formula 3)}$$

$$\mathrm{Hist}LY[2]=\mathrm{Hist}Y[8]+\mathrm{Hist}Y[9]+\mathrm{Hist}Y[10]+\mathrm{Hist}Y[11] \quad \text{(Formula 4)}$$

$$\mathrm{Hist}LY[3]=\mathrm{Hist}Y[12]+\mathrm{Hist}Y[13]+\mathrm{Hist}Y[14]+\mathrm{Hist}Y[15] \quad \text{(Formula 5)}$$

Figure 3:
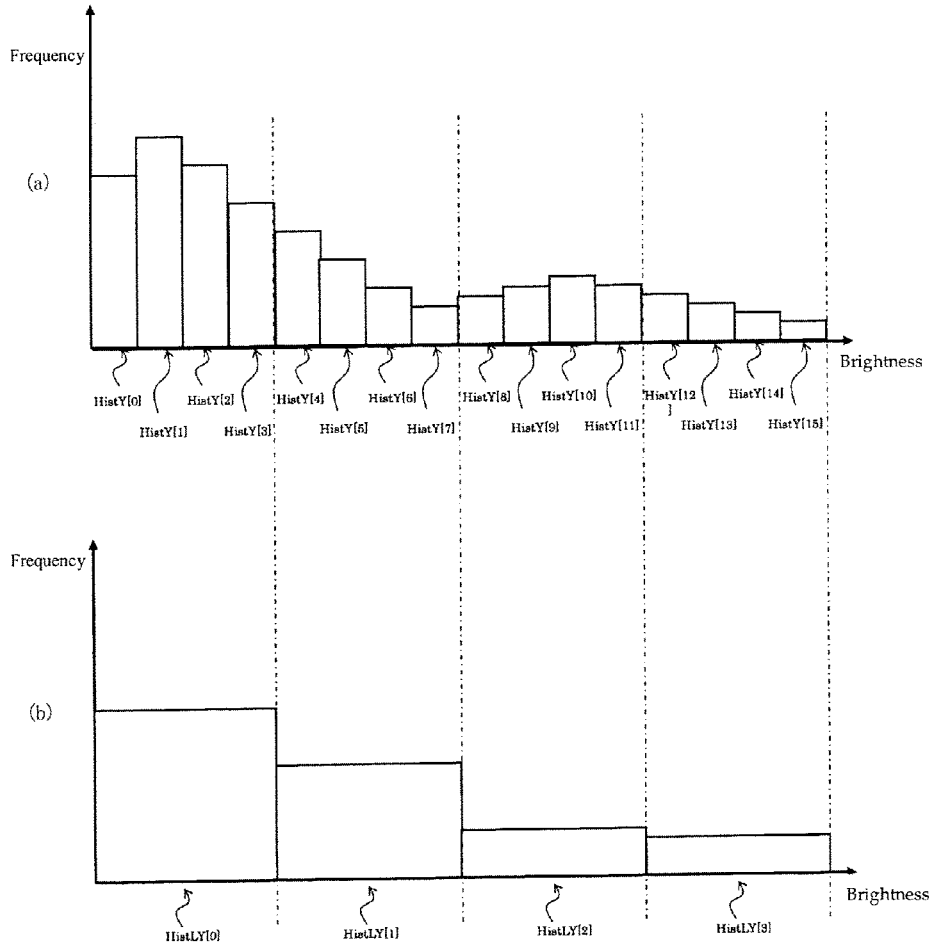
FIG. 3 shows an example of a 16-level histogram and a 4-level histogram.

As an example, FIG. 3 shows a 16-level histogram and a 4-level histogram that were acquired for luminance signal Y. In FIG. 3, upper portion (a) shows the 16-level histogram and lower portion (b) shows the 4-level histogram.

Histogram acquisition unit 102 further has four HistLR[0]–HistLR[3] as registers for creating a 4-level histogram relating to the red signal R. The count values of HistLR[0]–HistLR[3] are added in accordance with the following Formulas 6-9, whereby a 4-level histogram can be calculated from a 16-level histogram for the red signal R.

$$\mathrm{Hist}LR[0]=\mathrm{Hist}R[0]+\mathrm{Hist}R[1]+\mathrm{Hist}R[2]+\mathrm{Hist}R[3] \quad \text{(Formula 6)}$$

$$\mathrm{Hist}LR[1]=\mathrm{Hist}R[4]+\mathrm{Hist}R[5]+\mathrm{Hist}R[6]+\mathrm{Hist}R[7] \quad \text{(Formula 7)}$$

$$\mathrm{Hist}LR[2]=\mathrm{Hist}R[8]+\mathrm{Hist}R[9]+\mathrm{Hist}R[10]+\mathrm{Hist}R[11] \quad \text{(Formula 8)}$$

$$\mathrm{Hist}LR[3]=\mathrm{Hist}R[12]+\mathrm{Hist}R[13]+\mathrm{Hist}R[14]+\mathrm{Hist}R[15] \quad \text{(Formula 9)}$$

Still further, histogram acquisition unit 102 has four HistLG[0]–HistLG[3] as registers for creating a four-level histogram relating to the green signal G. The count values of HistLG[0]–HistLG[3] are added in accordance with the following Formulas 10-13, whereby a four-level histogram can be calculated from a 16-level histogram for the green signal G.

$$\mathrm{Hist}LG[0]=\mathrm{Hist}G[0]+\mathrm{Hist}G[1]+\mathrm{Hist}G[2]+\mathrm{Hist}G[3] \quad \text{(Formula 10)}$$

$$\mathrm{Hist}LG[1]=\mathrm{Hist}G[4]+\mathrm{Hist}G[5]+\mathrm{Hist}G[6]+\mathrm{Hist}G[7] \quad \text{(Formula 11)}$$

$$\mathrm{Hist}LG[2]=\mathrm{Hist}G[8]+\mathrm{Hist}G[9]+\mathrm{Hist}G[10]+\mathrm{Hist}G[11] \quad \text{(Formula 12)}$$

$$\mathrm{Hist}LG[3]=\mathrm{Hist}G[12]+\mathrm{Hist}G[13]+\mathrm{Hist}G[14]+\mathrm{Hist}G[15] \quad \text{(Formula 13)}$$

Finally, histogram acquisition unit 102 has four HistLB[0]–HistLB[3] as registers for creating a four-level histogram relating to the blue signal B. The count values of HistLB[0]–HistLB[3] are added in accordance with the following Formulas 14-17, whereby a four-level histogram can be calculated from a 16-level histogram for the blue signal B.

$$\mathrm{Hist}LB[0]=\mathrm{Hist}B[0]+\mathrm{Hist}B[1]+\mathrm{Hist}B[2]+\mathrm{Hist}B[3] \quad \text{(Formula 14)}$$

$$\mathrm{Hist}LB[1]=\mathrm{Hist}B[4]+\mathrm{Hist}B[5]+\mathrm{Hist}B[6]+\mathrm{Hist}B[7] \quad \text{(Formula 15)}$$

$$\mathrm{Hist}LB[2]=\mathrm{Hist}B[8]+\mathrm{Hist}B[9]+\mathrm{Hist}B[10]+\mathrm{Hist}B[11] \quad \text{(Formula 16)}$$

$$\mathrm{Hist}LB[3]=\mathrm{Hist}B[12]+\mathrm{Hist}B[13]+\mathrm{Hist}B[14]+\mathrm{Hist}B[15] \quad \text{(Formula 17)}$$

Histogram acquisition unit 102 supplies the four-level histograms and the 16-level histograms that were acquired for each of the luminance signal Y, red signal R, green signal G, and blue signal B to analysis unit 103.

Analysis unit 103 judges whether dimming control of light source 4 is to be implemented on the basis of the four-level histograms relating to each of the luminance signal Y, red signal R, green signal G, and blue signal B.

The determination of whether to implement dimming control is described in more concrete terms hereinbelow.

Analysis unit 103 first ranks each of the levels regarding the four-level histograms relating to each of the luminance signal Y, red signal R, green signal G, and blue signal B.

More specifically, analysis unit 103 carries out ranking of first, second, third, and fourth from the higher frequencies (histogram count numbers) for the four-level histograms HistLY[0]–HistLY[3] relating to luminance signal Y.

Taking as an example the four-level histogram relating to luminance signal Y shown in portion (b) of FIG. 3, HistLY[0]–HistLY[3] are ranked as shown below:

HistLY[0]: first
HistLY[1]: second
HistLY[2]: third
HistLY[3]: fourth Similar to the case for luminance signal Y, analysis unit 103 further ranks each of the levels on the basis of the frequencies (histogram count numbers) for the four-level histograms relating to each of the red signal R, green signal G, and blue signal B.

Analysis unit 103 next determines whether the following conditions 1-4 are satisfied:

(Condition 1) Of HistLY[0]–HistLY[3], the rank of HistLY[0] is first.

(Condition 2) Of HistLR[0]–HistLR[3], the rank of HistLR[3] is not first.

(Condition 3) Of HistLG[0]–HistLG[3], the rank of HistLG[3] is not first.

(Condition 4) Of HistLB[0]–HistLB[3], the rank of HistLB[3] is not first.

When all of the above conditions 1-4 are met, analysis unit 103 determines that dimming control is to be implemented. If even one of the above conditions 1-4 is not satisfied, analysis unit 103 determines that dimming control is not to be implemented.

Analysis unit 103 supplies, to dimming level calculation unit 104, the dimming control implementation determination result that indicates the result of determining whether to carry out dimming control. When a dimming control implementation determination result indicating that dimming control is to be carried out is supplied to dimming level calculation unit 104, analysis unit 103 also supplies the 16-level histogram relating to luminance signal Y that was acquired by histogram acquisition unit 102 to dimming level calculation unit 104 together with the dimming control implementation determination result.

Upon receiving from analysis unit 103 a dimming control implementation determination result that indicates that dimming control is not to be implemented, dimming level calculation unit 104 supplies 1.0 as the dimming rate such that light source 4 supplies the maximum luminance Upon receiving from analysis unit 103 a dimming control implementation determination result indicating that dimming control is to be carried out and a 16-level histogram relating to luminance signal Y, dimming level calculation unit 104 uses the 16-level histogram to calculate the dimming rate.

The procedure for calculating the dimming rate is next described in more concrete terms. Dimming level calculation unit 104 first calculates the dimming degree. The dimming degree is an index that indicates the extent to which the brightness of light source 4 is to be darkened and its value is given in a range from 0 to 1.0. Light source 4 is darkened in proportion to higher values of the dimming degree and light source 4 is brightened in proportion to lower values of the dimming degree.

Dimming level calculation unit 104 uses HistY[0], HistY[1], HistY[2], and HistY[3] of a 16-level histogram relating to luminance signal Y to calculate the dimming degree. In calculating the dimming degree, dimming level calculation unit 104 carries out an optimization operation for taking HistY[0], HistY[1], HistY[2], and HistY[3] as proportions of the entire screen. More specifically, dimming level calculation unit 104 carries out optimization by dividing the frequencies (the histogram count numbers) by the number of picture elements of the entire screen for each of HistY[0], HistY[1], HistY[2], and HistY[3]. Thus, the maximum value of the value that each of HistY[0], HistY[1], HistY[2], and HistY[3] can take is 1. Dimming level calculation unit 104 has Hist[0], Hist[1], Hist[2], and Hist[3] as registers that hold the optimization values. The optimized values of each of HistY[0], HistY[1], HistY[2], and HistY[3] are held in these Hist[0], Hist[1], Hist[2], and Hist[3], respectively.

For example, when display element 5 is provided with a screen having the resolution of VGA (Video Graphics Array) and, as input as RGB signal S1, 640×480 image data are received, dimming level calculation unit 104 carries out an optimization operation in accordance with the following Formulas 18-21.

$$\text{Hist}[0]=\text{Hist}Y[0]\div(640\times480) \quad \text{(Formula 18)}$$

$$\text{Hist}[1]=\text{Hist}Y[1]\div(640\times480) \quad \text{(Formula 19)}$$

$$\text{Hist}[2]=\text{Hist}Y[2]\div(640\times480) \quad \text{(Formula 20)}$$

$$\text{Hist}[3]=\text{Hist}Y[3]\div(640\times480) \quad \text{(Formula 21)}$$

Dimming level calculation unit 104 next uses Hist[0]–Hist[3] to calculate the dimming degree. More specifically, because dimming is carried out in proportion to the percentage of dark picture elements that occupy the entire screen, dimming level calculation unit 104 calculates the dimming degree by means of Formula 22 below.

[Numerical Expression 1]

$$\text{Dimming degree} = Hist[0] + \left(\frac{Hist[1]}{2}\right) + \left(\frac{Hist[2]}{4}\right) + \left(\frac{Hist[3]}{8}\right) \quad \text{(Formula 22)}$$

Dimming level calculation unit 104 next calculates the dimming rate on the basis of the calculated dimming degree by means of the following Formula 23.

$$\text{dimming rate}=1.0-(\text{dimming degree}\times\text{maximum dimming gain}) \quad \text{(Formula 23)}$$

When the dimming rate is 0, light source 4 is completely extinguished. Normally, when light source 4 is completely extinguished, this leads to problems such as an increase in the amount of time that is needed to stabilize at the luminance of light source 4 when it is relit. As a result, the maximum dimming gain is set such that the dimming rate will not become 0 and light source 4 will not be extinguished in the present exemplary embodiment.

Figure 4:
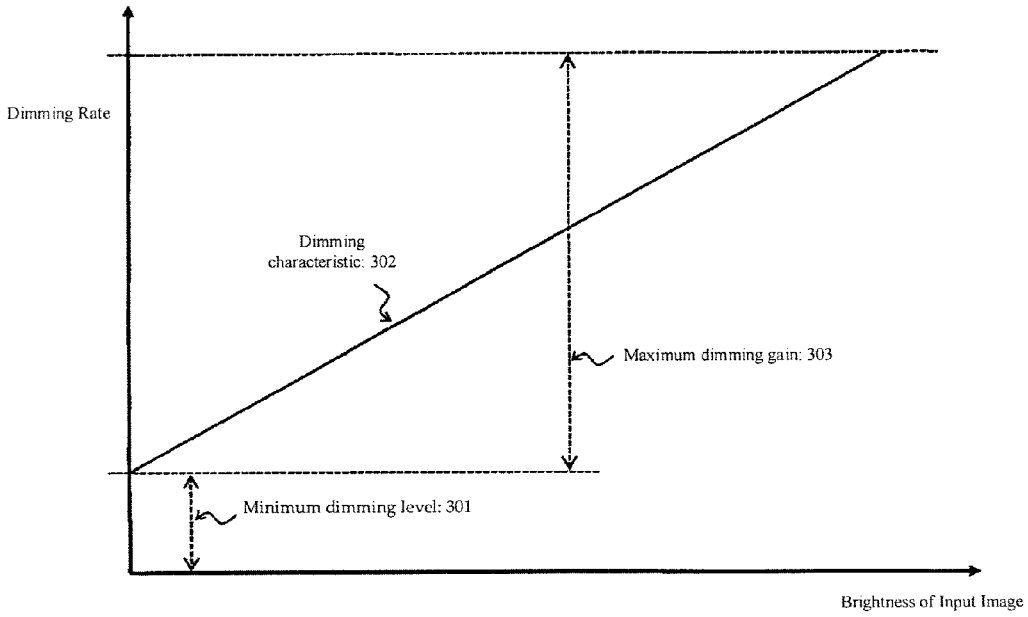
FIG. 4 is a characteristics diagram showing the relation between the brightness of an input image and the dimming rate.

FIG. 4 shows the relation between the brightness of the input image and the dimming rate. The horizontal axis shows the brightness of the input image, in which progression toward the left side indicates images that have a larger number of dark picture elements. The vertical axis shows the dimming rate, in which progression downward indicates a lower dimming rate and darkening of the light source, and conversely, progression upward indicates a higher dimming rate and brightening of the light source.

The minimum dimming level 301 is set such that light source 4 is not extinguished. Dimming characteristic 302 is a straight-line linear function that changes from minimum dimming level 301 to the maximum dimming level, the dimming rate decreasing in proportion to the increase in the number of dark picture elements contained in an input image and the dimming rate increasing in proportion to the increase in the bright picture elements. The range of levels obtained by subtracting the minimum dimming level 301 from the maximum dimming level is the maximum dimming gain 303. According to Formula 23 above, a dimming rate is used that is within the maximum dimming gain 303, and light source 4 therefore is not extinguished.

Dimming level calculation unit 104 supplies dimming signal S2, that indicates the calculated dimming rate, to light source drive unit 2 and to signal gain multiplying rate calculation unit 105.

Signal gain multiplying rate calculation unit 105 calculates the multiplying rate by means of Formula 24 below on the basis of the dimming rate that is indicated by dimming signal S2.

$$\text{multiplying rate}=1.0\div\text{dimming rate} \quad \text{(Formula 24)}$$

Signal gain multiplying rate calculation unit 105 supplies a multiplying rate signal that indicates the multiplying rate that was calculated by Formula 24 above to signal gain multiplication unit 106. Signal gain multiplication unit 106 is supplied with RGB signal S1 from an outside picture supply device.

Signal gain multiplication unit 106 amplifies the amplitude of RGB signal S1 in accordance with the multiplying rate that is indicated by the multiplying rate signal from signal gain multiplying rate calculation unit 105. More specifically, signal gain multiplication unit 106 multiplies each of the red signal R, green signal G, and blue signal B that are supplied as RGB signal S1 by the multiplying rate indicated by the multiplying rate signal in accordance with Formulas 25-27 shown below. Signal gain multiplication unit 106 then supplies RGB signal S3 that contains the red signal R, green signal G, and blue signal B that have been multiplied by the multiplying rate.

$$R\ \text{output}=R\ \text{input}\times\text{multiplying rate} \quad \text{(Formula 25)}$$

$$G\ \text{output}=G\ \text{input}\times\text{multiplying rate} \quad \text{(Formula 26)}$$

$$B\ \text{output}=B\ \text{input}\times\text{multiplying rate} \quad \text{(Formula 27)}$$

Display element drive unit 3 drives display element 5 in accordance with RGB signal S3. Because the amplitudes of the red signal R, green signal G, and blue signal B of RGB signal S3 have each been increased or decreased in accordance with the multiplying rate, the brightness of the image that is displayed by display element 5 changes according to the multiplying rate.

On the other hand, light source drive unit 2 increases or decreases the drive power (drive current or drive voltage) that is supplied to light source 4 according to the dimming rate that is indicated by dimming signal S2. When the dimming rate is 1.0, the drive power is the maximum and light source 4 is in the maximum luminance output state. When the dimming rate decreases, the drive power decreases and the luminance of light source 4 also decreases. When the luminance of light source 4 changes in accordance with the dimming rate, the brightness of the image that is displayed by display element 5 changes with this change in the luminance of light source 4.

The brightness of the image darkens to the extent that light source 4 darkens according to the dimming rate, but because the multiplying rate is the reciprocal of the dimming rate as shown in Formula 24 above, the apparent brightness of the image can be returned to normal by amplifying the amplitude of RGB signal S3 in accordance with the multiplying rate. In this way, excellent reproduction of black can be achieved while at the same time maintaining the brightness of half tones.

The dimming control operation of the image display device of the present exemplary embodiment is next described.

Figure 5:
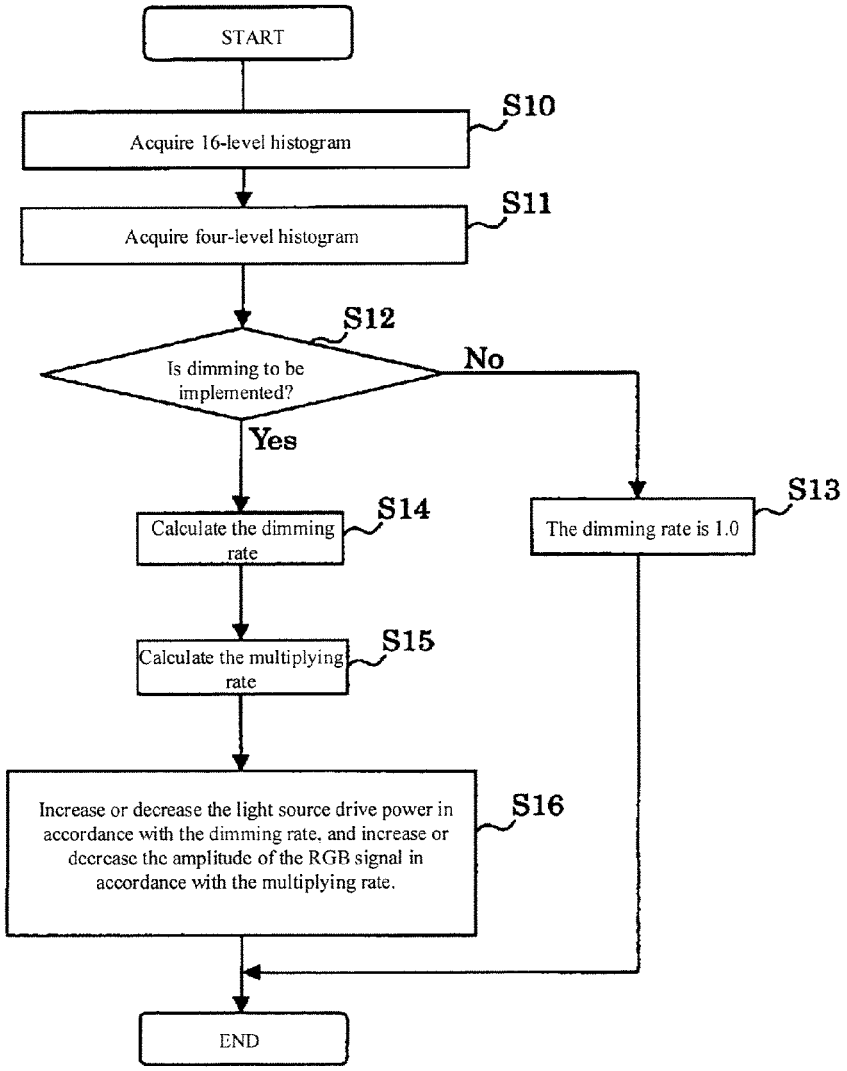
FIG. 5 is a flow chart showing the procedure of dimming control operations carried out in the image display device shown in FIG. 1.

FIG. 5 shows the procedure of the dimming control operation.

Histogram acquisition unit 102 first calculates luminance signal Y from RGB signal S1 and acquires 16-level histograms for each of luminance signal Y, red signal R, green signal G, and blue signal B (Step S10).

Histogram acquisition unit 102 next acquires four-level histograms for each of luminance signal Y, red signal R, green signal G, and blue signal B (Step S11). At this point in time, two or more items of statistical data have been acquired.

Analysis unit 103 next determines whether to implement dimming on the basis of the four-level histograms acquired in Step S11 (Step S12). This determination is performed on the basis of the above-described conditions 1-4.

When analysis unit 103 has determined that dimming is not to be performed, dimming level calculation unit 104 supplies dimming signal S2, that indicates that the dimming rate is 1.0, to light source drive unit 2 (Step S13). In this case, light source 4 is in the maximum luminance output state.

When analysis unit 103 determines that dimming is to be implemented, dimming level calculation unit 104 uses a 16-level histogram relating to luminance signal Y to calculate the dimming rate (Step S14). In this dimming rate calculation, dimming level calculation unit 104 calculates the dimming degree on the basis of the above-described Formula 22 and then calculates the dimming rate based on the calculated dimming degree by means of Formula 23 above Dimming level calculation unit 104 then supplies dimming signal S2 that indicates the calculated dimming rate to both light source drive unit 2 and signal gain multiplying rate calculation unit 105.

Signal gain multiplying rate calculation unit 105 next calculates the multiplying rate on the basis of the dimming rate that is indicated by dimming signal S2 by means of the above-described Formula 23 and supplies a multiplying rate signal that indicates the calculated multiplying rate to signal gain multiplication unit 106 (Step S15).

Finally, light source drive unit 2 supplies drive power that accords with the dimming rate that is indicated by dimming signal S2 to light source 4, and signal gain multiplication unit 106 supplies display element drive unit 3 with RGB signal S3 in which the amplitude is amplified in accordance with the multiplying rate that is indicated by the multiplying rate signal (Step S16). Display element drive unit 3 then drives display element 5 in accordance with RGB signal S3.

The following action and effects are exhibited by the image display device of the present exemplary embodiment.

Because a histogram (a detailed histogram) that has many levels as 16 levels is used to determine the dimming rate, the adjustment of luminance of light source 4 can be accurately carried out. In this way, an image having natural brightness and color harmony can be provided with stability.

In addition, because a histogram (a rough histogram) that has few levels as four is used to detect the characteristics of the image and the determination of whether to implement dimming control is then carried out on the basis of the detected characteristics, the determination process is free of complexity.

When displaying black in a display device such as a liquid crystal display or a liquid crystal projector, it has been difficult until now to satisfactorily produce black due to light leakage from the liquid crystal device. By means of the image display device of the present exemplary embodiment, good black reproduction can be realized by adjusting the brightness level of the light source. In addition, by amplifying the amplitude of RGB signal S3 in accordance with the multiplying rate, any reduction in the brightness of half tones due to darkening of light source 4 can be limited. In this way, good reproduction of black can be realized while at the same time maintaining the brightness of half tones.

In addition, by determining whether to perform dimming control on the basis of the previously described conditions 1-4, the following action and effects can be further obtained.

According to the previously described Formula 1, the red image, green image, and blue image are all made darker than the original brightness due to luminance conversion. As a result, when the determination of whether to implement dimming control is performed in accordance with only condition 1, dimming control is carried out for a bright single-color image, resulting in a dark image. For example, the originally bright image cannot be provided when dimming control is performed for an image of an absolutely blue sky, an image of an evening glow or brilliant red rose, or an image of a green mountain. Through the use of conditions 2-4 in addition to condition 1 in the present exemplary embodiment, dimming control is not implemented for bright single-color images.

In the previously described Formula 1, the luminance conversion rates of each of the blue image, red image, and green image are set to 0.114, 0.299, and 0.587, respectively, the luminance conversion rate of the blue image being the lowest. The above-described problem of dimming a bright single-color image is therefore most conspicuous for the blue image. As a result, the determination of whether to implement dimming control may also be carried out on the basis of condition 1 and condition 4.

In addition, taking into account that the luminance conversion rate of the red image is the next lowest after that of the blue image, determining whether to implement dimming control may also be carried out on the basis of condition 1, condition 2, and condition 4.

When the above-described problem of dimming for single-color images is not taken into consideration, determining whether to implement dimming control may be carried out on the basis of only condition 1. This determination is effective when displaying a black-and-white image.

Finally, when a simple determination is made whether to implement dimming control, the determination may be made without using condition 1, but on the basis of any one of the conditions from among condition 2, condition 3 or condition 4.

Although a 16-level histogram and a four-level histogram are acquired for each of luminance signal Y, red signal R, green signal G, and blue signal B in the present exemplary embodiment, the present invention is not limited to this form. A 16-level histogram and a four-level histogram may be acquired for only luminance signal Y, and four-level histograms may be acquired directly from the image data for the red signal R, green signal G, and blue signal B.

Further, although histograms are acquired for each frame, the present invention is not limited to this form. Histograms may be acquired at intervals of several frames. For example, histograms may be acquired for every five frames. However, histograms are acquired based on one-frame portions of image data.

(Second Exemplary Embodiment)

The image display device according to the second exemplary embodiment of the present invention also includes the configuration shown in FIG. 1 and FIG. 2, but the second exemplary embodiment differs from the first exemplary embodiment in that dimming control is implemented using an eight-level histogram and a four-level histogram. In the following explanation, explanation will focus on the configuration that differs from that of the first exemplary embodiment, and explanation of identical configurations will be omitted.

Histogram acquisition unit 102 calculates luminance signal Y from RGB signal S1 in accordance with the previously described Formula 1 and acquires an eight-level histogram and a four-level histogram for each of luminance signal Y, red signal R, green signal G, and blue signal B. The acquisition of these histograms is carried out in one-frame units.

The procedure of acquiring an eight-level histogram when RGB signal S1 is eight-bit digital data is described hereinbelow.

Histogram acquisition unit 102 has eight registers HistY[0]–HistY[7] for creating an eight-level histogram relating to luminance signal Y. These registers HistY[0]–HistY[7] are reset to 0 at the time of starting a frame, and are configured to hold count values at the time of completion of a frame. The count values of the corresponding registers among registers HistY[0]–HistY[7] are added in accordance with the input data of luminance signal Y according to the addition conditions shown in Table 2 below. An eight-level histogram relating to luminance signal Y can thus be acquired.

TABLE 2

| NO | Input Data | Register to be Added |
|---|---|---|
| 0 | 32 > Y ≥ 0 | HistY[0] |
| 1 | 64 > Y ≥ 32 | HistY[1] |
| 2 | 96 > Y ≥ 64 | HistY[2] |
| 3 | 128 > Y ≥ 96 | HistY[3] |
| 4 | 160 > Y ≥ 128 | HistY[4] |
| 5 | 192 > Y ≥ 160 | HistY[5] |
| 6 | 224 > Y ≥ 192 | HistY[6] |
| 7 | 256 > Y ≥ 224 | HistY[7] |

Histogram acquisition unit 102 has registers HistR[0]–HistR[7] for red signal R, HistG[0]–HistG[7] for green signal G, and HistB[0]–HistB[7] for blue signal B. These registers HistR[0]–HistR[7], HistG[0]–HistG[7], and HistB[0]–HistB[7] are also reset to 0 at the starting time of a frame and are configured to hold count values at the time of completion of a frame.

The addition conditions of the red signal R are given by converting the registers that are to be added in Table 2 above from HistY[0]–HistY[7] to HistR[0]–HistR[7]. In accordance with these addition conditions, the count values of the corresponding registers among registers HistR[0]–HistR[7] are added according to the input data of the red signal R. In this way, an eight-level histogram relating to the red signal can be acquired.

The addition conditions of the green signal G are given by converting the registers that are to be added in Table 2 above from HistY[0]–HistY[7] to HistG[0]–HistG[7]. In accordance with these addition conditions, the count values of the corresponding registers among registers HistG[0]–HistG[7] are added according to the input data of the green signal G. In this way, an eight-level histogram relating to the green signal can be acquired.

The addition conditions of the blue signal B are given by converting the registers that are to be added in Table 2 above from HistY[0]–HistY[7] to HistB[0]–HistB[7]. In accordance with these addition conditions, the count values of the corresponding registers among registers HistB[0]–HistB[7] are added according to the input data of the blue signal B. In this way, an eight-level histogram relating to the blue signal can be acquired.

In addition, histogram acquisition unit 102 has four registers HistLY[0]–HistLY[3] for creating a four-level histogram relating to luminance signal Y. Count values are added to registers HistLY[0]–HistLY[3] in accordance with Formulas 28-31 below. In this way, a four-level histogram can be calculated from a 16-level histogram for luminance signal Y.

$$\mathrm{Hist}LY[0]=\mathrm{Hist}Y[0]+\mathrm{Hist}Y[1] \quad \text{(Formula 28)}$$

$$\mathrm{Hist}LY[1]=\mathrm{Hist}Y[2]+\mathrm{Hist}Y[3] \quad \text{(Formula 29)}$$

$$\mathrm{Hist}LY[2]=\mathrm{Hist}Y[4]+\mathrm{Hist}Y[5] \quad \text{(Formula 30)}$$

$$\mathrm{Hist}LY[3]=\mathrm{Hist}Y[6]+\mathrm{Hist}Y[7] \quad \text{(Formula 31)}$$

Figure 6:
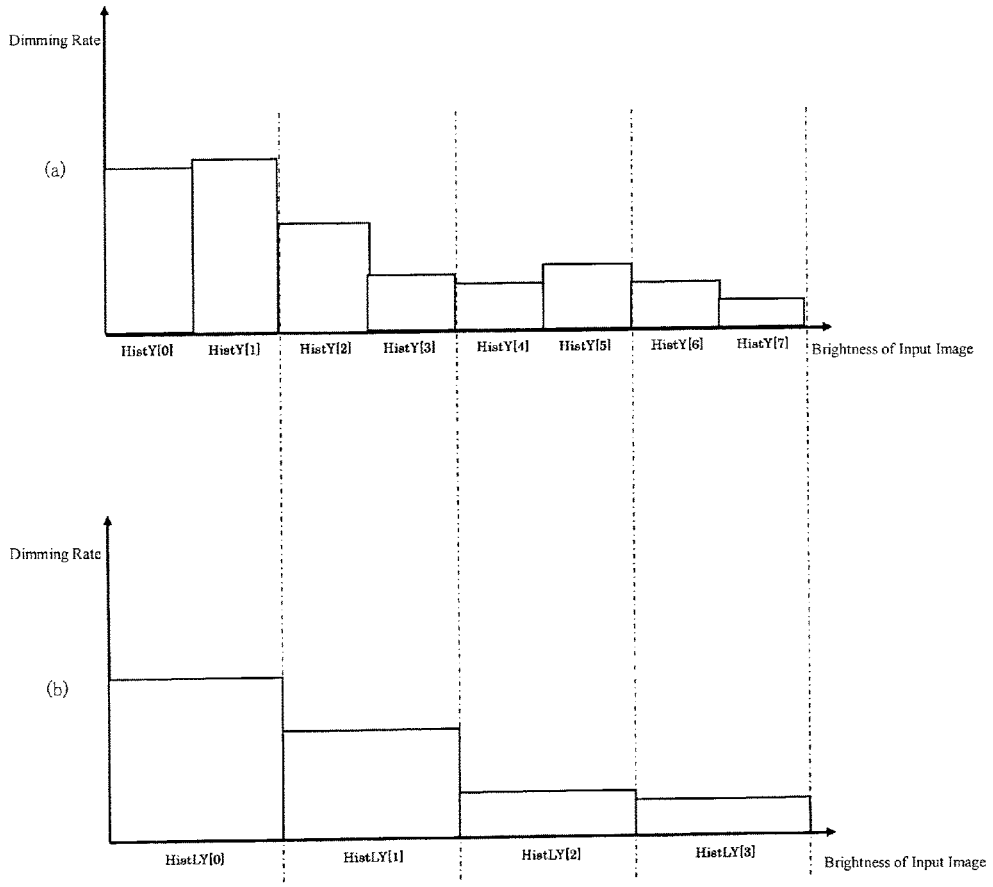
FIG. 6 shows an example of an 8-level histogram and a 4-level histogram.

As an example, FIG. 6 shows an eight-level histogram and a four-level histogram that have been acquired for luminance signal Y. In FIG. 6, the upper figure portion (a) shows the eight-level histogram, and the lower figure portion (b) shows the four-level histogram.

Histogram acquisition unit 102 further has four HistLR[0]–HistLR[3] for creating a four-level histogram relating to the red signal R. The count values of HistLR[0]–HistLR[3] are added in accordance with Formulas 32-35 below. In this way, a four-level histogram can be calculated from an eight-level histogram for the red signal R.

$$\mathrm{Hist}LR[0]=\mathrm{Hist}R[0]+\mathrm{Hist}R[1] \quad \text{(Formula 32)}$$

$$\mathrm{Hist}LR[1]=\mathrm{Hist}R[2]+\mathrm{Hist}R[3] \quad \text{(Formula 33)}$$

$$\mathrm{Hist}LR[2]=\mathrm{Hist}R[4]+\mathrm{Hist}R[5] \quad \text{(Formula 34)}$$

$$\mathrm{Hist}LR[3]=\mathrm{Hist}R[6]+\mathrm{Hist}R[7] \quad \text{(Formula 35)}$$

Histogram acquisition unit 102 further has four HistLG[0]–HistLG[3] for creating a four-level histogram relating to the green signal G. The count values of HistLG[0]–HistLG

[3] are added in accordance with Formulas 36-39 below. In this way, a four-level histogram can be calculated from an eight-level histogram for the green signal G.

$$HistLG[0]=HistG[0]+HistG[1] \quad \text{(Formula 36)}$$

$$HistLG[1]=HistG[2]+HistG[3] \quad \text{(Formula 37)}$$

$$HistLG[2]=HistG[4]+HistG[5] \quad \text{(Formula 38)}$$

$$HistLG[3]=HistG[6]+HistG[7] \quad \text{(Formula 39)}$$

Histogram acquisition unit 102 further has four HistLB[0]–HistLB[3] for creating a four-level histogram relating to the blue signal B. The count values of HistLB[0]–HistLB[3] are added in accordance with Formulas 40-43 below. In this way, a four-level histogram can be calculated from an eight-level histogram for the blue signal B.

$$HistLB[0]=HistB[0]+HistB[1] \quad \text{(Formula 40)}$$

$$HistLB[1]=HistB[2]+HistB[3] \quad \text{(Formula 41)}$$

$$HistLB[2]=HistB[4]+HistB[5] \quad \text{(Formula 42)}$$

$$HistLB[3]=HistB[6]+HistB[7] \quad \text{(Formula 43)}$$

Histogram acquisition unit 102 supplies the eight-level histograms and the four-level histograms that were acquired for each of luminance signal Y, red signal R, green signal G, and blue signal B to analysis unit 103.

Analysis unit 103 performs ranking on the basis of the frequency (histogram count numbers) for each level of the four-level histograms relating to each of luminance signal Y, red signal R, green signal G, and blue signal B.

Taking as an example the four-level histogram relating to luminance signal Y shown in the lower portion (b) of FIG. 6, HistLY[0]–HistLY[3] are ranked as shown below.

HistLY[0]: First
HistLY[1]: Second
HistLY[2]: Third
HistLY[3]: Fourth Analysis unit 103 determines whether to perform dimming control of light source 4 on the basis of the above-described conditions 1-4. As in the first exemplary embodiment, analysis unit 103 determines that dimming control is to be performed when all of conditions 1-4 have been satisfied. Analysis unit 103 determines that dimming control is not to be performed if even one of conditions 1-4 is not met.

Analysis unit 103 supplies dimming level calculation unit 104 with a dimming control implementation determination result that indicates the result of the determination of whether to perform dimming control. When a dimming control implementation determination result that indicates that dimming control is to be performed is supplied to dimming level calculation unit 104, analysis unit 103 supplies the eight-level histogram relating to luminance signal Y that was acquired in histogram acquisition unit 102 together with the dimming control implementation determination result to dimming level calculation unit 104.

Upon receiving a dimming control implementation determination result indicating that dimming control is not to be carried out from analysis unit 103, dimming level calculation unit 104 supplies 1.0 as the dimming rate such that light source 4 supplies maximum luminance Upon receiving from analysis unit 103 a dimming control implementation determination result indicating that dimming control is to be carried out and an eight-level histogram relating to luminance signal Y, dimming level calculation unit 104 uses the eight-level histogram to calculate the dimming rate.

In calculating the dimming rate, dimming level calculation unit 104 first uses HistY[0] and HistY[1] of the eight-level histogram to calculate the dimming degree Dimming level calculation unit 104 has registers Hist[0] and Hist[1]. The optimized values of each of HistY[0] and HistY[1] are stored in these registers Hist[0] and Hist[1], respectively. For example, when display element 5 is equipped with a screen having VGA (Video Graphics Array) resolution and 640×480 image data are received as RGB signal S1, dimming level calculation unit 104 performs an optimization operation in accordance with the following Formulas 44-45.

$$Hist[0]=HistY[0]\div(640\times480) \quad \text{(Formula 44)}$$

$$Hist[1]=HistY[1]\div(640\times480) \quad \text{(Formula 45)}$$

After the optimization operation, dimming level calculation unit 104 uses Hist[0] and Hist[1] to calculate the dimming degree by means of the following Formula 46.

[Numerical Expression 2]

$$\text{Dimming degree} = Hist[0] + \left(\frac{Hist[1]}{2}\right) \quad \text{(Formula 46)}$$

Dimming level calculation unit 104 next calculates the dimming rate on the basis of the calculated dimming degree by means of the previously described Formula 23 Dimming level calculation unit 104 then supplies dimming signal S2, that indicates the calculated dimming rate, to light source drive unit 2 and to signal gain multiplying rate calculation unit 105.

Signal gain multiplying rate calculation unit 105 and signal gain multiplication unit 106 are the same as in the first exemplary embodiment and explanation is therefore here omitted.

The image device of the present exemplary embodiment also exhibits the same action and effects as the first exemplary embodiment. In addition, the same modifications as in the first exemplary embodiment are also possible in the present exemplary embodiment.

The present invention is not limited to the configuration and operations described in the first or second exemplary embodiment, and the configuration and operations are open to appropriate modifications within a scope that does not diverge from the gist of the invention.

For example, the number of levels of the histograms is not limited to 16, 8, and 4. Histograms having a more detailed number of levels other than 16 or 8 may be used in place of the 16-level or 8-level histogram, and a rougher histogram having a number of levels other than four may be used in place of a four-level histogram. However, when the number of levels is changed, the configuration of the registers for creating histograms, the addition conditions of Tables 1 and 2, and the calculation formulas of the dimming degree are modified as appropriate according to the number of levels.

For example, HistY[0]–HistY[m] (where m is a natural number equal to or greater than 1) are assumed to be the levels of brightness of a precise histogram relating to luminance signal Y and Hist[0]–Hist[m} are assumed to be values obtained by dividing the frequencies of each of HistY[0]–HistY[m] by the number of picture elements of display element 5. In this case, the dimming degree may be found by means of the following Formula 47.

[Numerical Expression 3]

$$\text{Dimming degree} = Hist[0] + \sum_{k=i}^{n} \frac{Hist[k]}{2^k} \quad \text{(Formula 47)}$$

A rough histogram may be created by collecting levels of brightness for every predetermined number from the side of lower brightness of a precise histogram. When the number of levels of a precise histogram is not divisible by the number of levels of the rough histogram, the number of levels that are collected on the side of lower brightness in the precise histogram may be greater than the number of levels that are collected in other portions. In this way, the calculation accuracy of the dimming degree can be improved.

Figure 7:
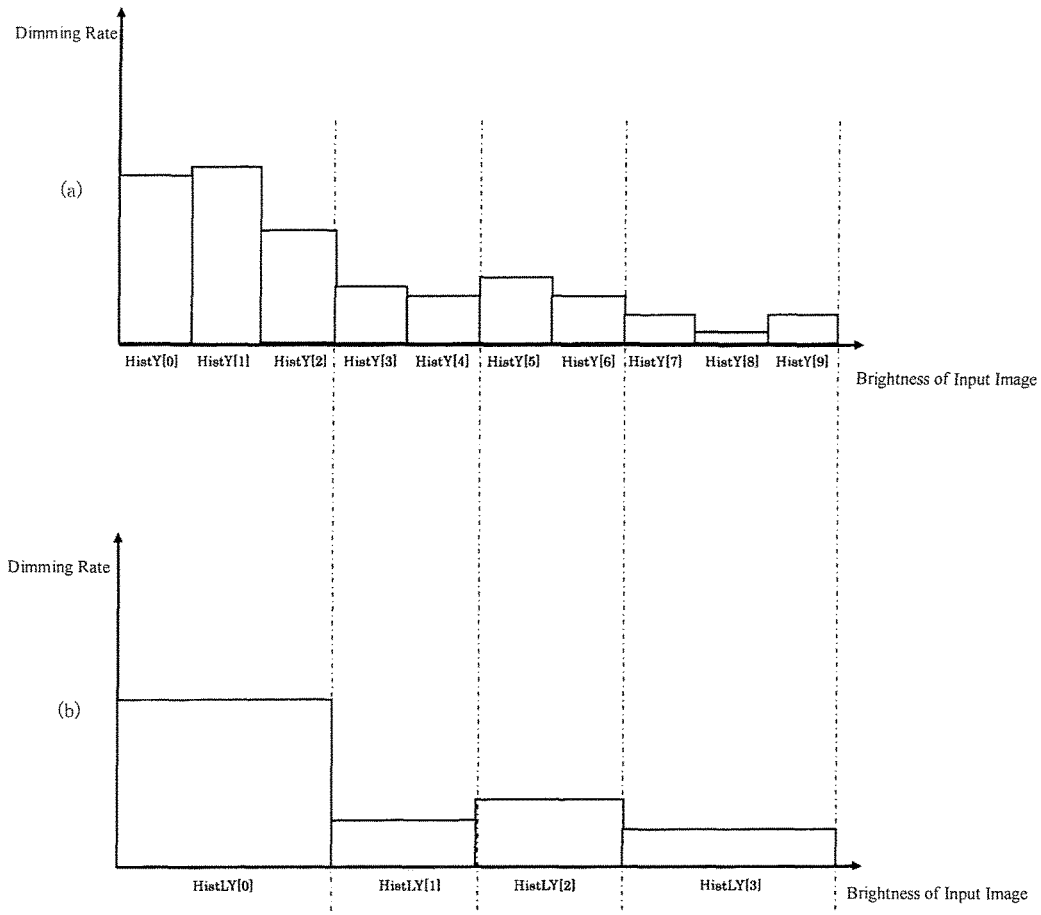
FIG. 7 shows an example of a 10-level histogram and a 4-level histogram.

As an example, FIG. 7 shows a ten-level histogram and a four-level histogram that have been acquired for luminance signal Y. In FIG. 7, the upper portion of the figure (a) shows the ten-level histogram, and the lower portion of the figure (b) shows the four-level histogram. The ten-level histogram is made up of HistY[0]–HistY[9], and the four-level histogram is made up of HistLY[0]–HistLY[3]. HistLY[0] is a value obtained by the addition of three HistY[0]–HistY[2]. HistLY[1] is the value obtained by adding two HistY[3] and HistY[4]. HistLY[2] is the value obtained by the addition of two HistY[5] and HistY[6]. HistLY[3] is the value obtained by the addition of three HistY[7]–HistY[9].

The present invention can be applied to a projector or to an image display device represented by a liquid crystal display. When the present invention is applied to a projector, a component such as a digital micromirror device (DMD) or a liquid crystal display element is used as display element 5. The image formed on display element 5 is projected upon a screen by means of a projection lens. A mercury lamp, a solid-state light source such as an LED, or a device that uses a phosphor can be applied as light source 4.

In addition, the present invention can adopt the forms shown in the following Supplementary Notes 1-16, but is not limited to these forms.

[Supplementary Note 1]

An image display device has:

a light source;

a display unit that spatially modulates light from the light source on the basis of an input video signal to form an image;

a histogram acquisition unit that acquires, on the basis of the input video signal, a first histogram, in which image data is indicated by the frequencies of levels of brightness, and a second histogram that has a number of levels of brightness that differs from the number of levels of brightness of the first histogram; and a control unit that implements dimming control for adjusting the luminance of the light source on the basis of the first histogram and the second histogram.

[Supplementary Note 2]

In the image display device as described in Supplementary Note 1, the number of levels of brightness of the second histogram is less than the number of levels of brightness of the first histogram.

[Supplementary Note 3]

In the image display device as described in Supplementary Note 2, the control unit determines whether to perform the dimming control on the basis of the second histogram, and when the dimming control is to be carried out, carries out the dimming control on the basis of the first histogram.

[Supplementary Note 4]

In the image display device as described in Supplementary Note 3:

the input video signal includes a red signal indicating a red image, a green signal indicating a green image, and a blue signal indicating a blue image;

the histogram acquisition unit both acquires first and second luminance histograms that are the first and second histograms for a luminance signal in which picture element values corresponding to each of the red image, green image, and blue image are added at predetermined ratios and acquires a color histogram that is the second histogram for at least one of the color signals of the red signal, green signal, and blue signal; and the control unit carries out the dimming control when, of each level of brightness of the second luminance histogram, the frequency of the lowest level is greater than the frequency of any other level, and moreover, of each level of brightness of the color histogram, the frequency of the highest level is less than the frequency of any other level.

[Supplementary Note 5]

In the image display device as described in Supplementary Note 4:

the histogram acquisition unit acquires a first color histogram that is the color histogram for the blue signal; and the control unit carries out the dimming control when, of each level of brightness of the second luminance histogram, the frequency of the lowest level is greater than the frequency of any of the other levels, and moreover, of each level of brightness of the first color histogram, the frequency of the highest level is lower than the frequency of any other level.

[Supplementary Note 6]

In the image display device as described in Supplementary Note 5:

the histogram acquisition unit further acquires a second color histogram that is the color histogram for the red signal; and the control unit carries out the dimming control when, of each level of brightness of the second luminance histogram, the frequency of the lowest level is greater than the frequency of any other level, and moreover, of each level of brightness for each of the first and second color histograms, the frequency of the highest level is lower than the frequency of any other level.

[Supplementary Note 7]

In the image display device as described in Supplementary Note 6:

the histogram acquisition unit further acquires a third color histogram that is the color histogram for the green signal; and the control unit carries out the dimming control when, of each level of brightness of the second luminance histogram, the frequency of the lowest level is greater than the frequency of any other level, and moreover, of each level of brightness for each of the first to third color histograms, the frequency of the highest level is lower than the frequency of any other level.

[Supplementary Note 8]

In the image display device as described in any one of Supplementary Notes 4 to 7:

the levels of brightness of the first luminance histogram are HistY[0]–HistY[m] (where m is a natural number equal to or greater than 1);

the control unit finds the dimming degree with the values derived by dividing the frequencies of each HistY[0]–HistY[m] by the number of picture elements of the display unit as Hist[0]–Hist[m] respectively by means of:

[Numerical Expression 4]

$$\text{Dimming degree} = Hist[0] + \sum_{k=1}^{n} \frac{Hist[k]}{2^k}$$

where n<m;

uses the dimming degree and the maximum dimming gain that is given in advance to find the dimming rate by means of:

dimming rate=1.0−(dimming degree×maximum dimming gain)

and:

adjusts luminance of the light source in accordance with the dimming rate.

[Supplementary Note 9]

In the image display device as described in Supplementary Note 8:

the control unit finds a multiplying rate as the reciprocal of the dimming rate; and multiplies each of the red signal, green signal and blue signal by the multiplying rate, and supplies the display unit with a video signal that contains the red signal, green signal, and blue signal.

[Supplementary Note 10]

In the image display device as described in any one of Supplementary Notes 1 to 9, the histogram acquisition unit collects the first histogram for every predetermined number of levels to create the second histogram.

[Supplementary Note 11]

In the image display device as described in Supplementary Note 10, of each level of brightness of the second histogram, the range of brightness of lower-side levels is greater than the range of brightness of other levels.

[Supplementary Note 12]

A light source dimming method of an image display device in which light from a light source is spatially modulated by means of a display element on the basis of an input video signal to display an image, the method including:

deriving two or more items of statistical data from the input video signal; and adjusting the luminance of the light source on the basis of the two or more items of statistical data.

[Supplementary Note 13]

A light source dimming method of an image display device in which light from a light source is spatially modulated by means of a display element on the basis of an input video signal to display an image, the method including:

acquiring, on the basis of the input video signal, a first histogram, in which image data is indicated by the frequencies of levels of brightness, and a second histogram that has a number of levels of brightness that differs from the number of levels of brightness of the first histogram; and performing dimming control that adjusts the luminance of the light source on the basis of the first histogram and the second histogram.

[Supplementary Note 14]

In the light source dimming method as described in Supplementary Note 13, the number of levels of brightness of the second histogram is less than the number of levels of brightness of the first histogram.

[Supplementary Note 15]

In the light source dimming method as described in Supplementary Note 14, the control unit determines whether to implement the dimming control on the basis of the second histogram, and when the dimming control is to be implemented, carries out the dimming control on the basis of the first histogram.

[Supplementary Note 16]

In the light source dimming method as described in Supplementary Note 15, the input video signal includes a red signal that indicates a red image, a green signal that indicates a green image, and a blue signal that indicates a blue image; and the method further includes:

both acquiring first and second luminance histograms that are the first and second histograms for a luminance signal in which picture element values corresponding to each of the red image, green image, and blue image are added at predetermined ratios and acquiring a color histogram that is the second histogram for at least one color signal of the red signal, green signal, and blue signal; and carrying out the dimming control only when, of each level of brightness of the second luminance histogram, the frequency of the lowest level is greater than the frequency of any other level, and moreover, of each level of brightness of the color histogram, the frequency of the highest level is lower than the frequency of any other level.

In the above-described image display devices of Notes 1-11, the light source can be realized by light source drive unit 2 and light source 4 shown in FIG. 1. The display unit can be realized by display element drive unit 3 and display element 5 shown in FIG. 1. The histogram acquisition unit can be realized by histogram acquisition unit 102 shown in FIG. 2. The control unit can be realized by analysis unit 103 and dimming level calculation unit 104 shown in FIG. 2. In this case, the control unit may include signal gain multiplying rate calculation unit 105 and signal gain multiplication unit 106 shown in FIG. 2.

EXPLANATION OF REFERENCE NUMBERS

1 light source dimming unit
2 light source drive unit
3 display element drive unit
4 light source
5 display element
102 histogram acquisition unit
103 analysis unit
104 dimming level calculation unit
105 signal gain multiplying rate calculation unit
106 signal gain multiplication unit 106

The invention claimed is:

1. An image display device, comprising:

a light source;

a display unit that spatially modulates light from said light source on a basis of an input video signal to form an image;

a histogram acquisition unit that acquires, on the basis of said input video signal, a first histogram, in which image data is indicated by frequencies of levels of brightness, and a second histogram that has a number of levels of brightness that differs from a number of levels of brightness of said first histogram; and a control unit that implements dimming control for adjusting a luminance of said light source on a basis of said first histogram and said second histogram, wherein a total sum of histogram count values of said first histogram is equal to a total sum of histogram count values of said second histogram.

2. The image display device as set forth in claim 1, wherein the number of levels of brightness of said second histogram is less than the number of levels of brightness of said first histogram.

3. The image display device as set forth in claim 2, wherein said control unit determines whether to perform said dimming control on a basis of said second histogram, and when said dimming control is to be carried out, carries out said dimming control on a basis of said first histogram.

4. The image display device as set forth in claim 3, wherein said input video signal includes a red signal indicating a red image, a green signal indicating a green image, and a blue signal indicating a blue image, wherein said histogram acquisition unit further acquires first and second luminance histograms that include said first and second histograms for a luminance signal in which picture element values corresponding to each of said red image, said green image, and said blue image are added at predetermined ratios, and further acquires a color histogram that is said second histogram for at least one color signal of said red signal, said green signal, and said blue signal, and wherein said control unit carries out said dimming control when, of each level of brightness of said second luminance histogram, a frequency of a lowest level is greater than a frequency of any other level, and, of each level of brightness of said color histogram, a frequency of the highest level is less than the frequency of any other level.

5. The image display device as set forth in claim 4, wherein said histogram acquisition unit acquires a first color histogram that includes said color histogram for said blue signal, and wherein said control unit carries out said dimming control when, of each level of brightness of said second luminance histogram, the frequency of the lowest level is greater than the frequency of any other level, and, of each level of brightness of said first color histogram, the frequency of the highest level is lower than the frequency of any other level.

6. The image display device as set forth in claim 5, Wherein said histogram acquisition unit further acquires a second color histogram that includes said color histogram for said red signal, and wherein said control unit carries out said dimming control when, of each level of brightness of said second luminance histogram, the frequency of the lowest level is greater than the frequency of any other level, and, of each level of brightness for each of said first and second color histograms, the frequency of the highest level is lower than the frequency of any other level.

7. The image display device as set forth in claim 6, wherein said histogram acquisition unit further acquires a third color histogram that includes said color histogram for said green signal, and wherein said control unit carries out said dimming control when, of each level of brightness of said second luminance histogram, the frequency of the lowest level is greater than the frequency of any other level, and, of each level of brightness for each of said first to third color histograms, the frequency of the highest level is lower than the frequency of any other level.

8. The image display device as set forth in claim 4, wherein the levels of brightness of said first luminance histogram are HistY[0]-HistY[m] (where m is a natural number equal to or greater than 1), and wherein said control unit finds a dimming degree with values derived by dividing frequencies of each HistY[0]-HistY[m] by a number of picture elements of said display unit as Hist[0]-Hist[m] respectively by:

[Numerical Expression 1]

$$\text{Dimming degree} = Hist[0] + \sum_{k=1}^{n} \frac{Hist[k]}{2^k}$$

where n<m;

uses said dimming degree and a maximum dimming gain that is given in advance to find a dimming rate by:

dimming rate=1.0−(dimming degree×maximum dimming gain); and adjusts luminance of said light source in accordance with the dimming rate.

9. The image display device as set forth in claim 8, wherein said control unit:

finds a multiplying rate as a reciprocal of said dimming rate; and multiplies each of said red signal, said green signal, and said blue signal by the multiplying rate, and supplies said display unit with a video signal that contains said red signal, said green signal, and said blue signal.

10. The image display device as set forth in claim 1, wherein said histogram acquisition unit collects said first histogram for every predetermined number of levels to create said second histogram.

11. The image display device as set forth in claim 10, wherein, of each level of brightness of said second histogram, a range of brightness of lower-side levels is greater than a range of brightness of other levels.

12. The image display device as set forth in claim 1, wherein said input video signal includes a red signal indicating a red image, a green signal indicating a green image, and a blue signal indicating a blue image, and wherein said histogram acquisition unit further acquires first and second luminance histograms that include said first and second histograms for a luminance signal in which picture element values corresponding to each of said red image, said green image, and said blue image are added at predetermined ratios.

13. The image display device as set forth in claim 12, wherein said histogram acquisition unit further acquires a color histogram that includes said second histogram for at least one color signal of said red signal, said green signal, and said blue signal.

14. The image display device as set forth in claim 13, wherein said control unit carries out said dimming control when, of each level of brightness of said second luminance histogram, a frequency of a lowest level is greater than a frequency of any other level.

15. The image display device as set forth in claim 14, wherein said control unit further carries out said dimming control when, of each level of brightness of said color histogram, a frequency of the highest level is less than the frequency of any other level.

16. The image display device as set forth in claim 12, wherein said control unit carries out said dimming control when, of each level of brightness of said color histogram, a frequency of the highest level is less than a frequency of any other level.

17. A light source dimming method of an image display device in which light from a light source is spatially modulated by a display element on a basis of an input video signal to display an image, said method comprising:

acquiring, on the basis of said input video signal, a first histogram, in which image data is indicated by frequencies of levels of brightness, and a second histogram that has a number of levels of brightness that differs from a number of levels of brightness of said first histogram; and performing dimming control that adjusts a luminance of said light source on a basis of said first histogram and said second histogram, wherein a total sum of histogram count values of said first histogram is equal to a total gum of histogram count values of said second histogram.

18. The light source dimming method as set forth in claim 17, wherein the number of levels of brightness of said second histogram is less than the number of levels of brightness of said first histogram.

19. The light source dimming method as set forth in claim 18, further comprising:

determining whether to implement said dimming control on a basis of said second histogram, and when said dimming control is to be implemented, performing said dimming control on a basis of said first histogram.

20. The light source dinning method as set forth in claim 19, wherein said input video signal includes a red signal that indicates a red image, a green signal that indicates a green image, and a blue signal that indicates a blue image, said light source dimming method further comprising:

acquiring first and second luminance histograms that include said first and second histograms for a luminance signal in which picture element values corresponding to each of said red image, said green image, and said blue image are added at predetermined ratios, and further acquiring a color histogram that is said second histogram for at least one color signal of said red signal, said green signal, and said blue signal; and carrying out said dimming control only when, of each level of brightness of said second luminance histogram, a frequency of a lowest level is greater than a frequency of any other level, and, of each level of brightness of said color histogram, a frequency of the highest level is lower than the frequency of any other level.

* * * * *